US007014547B2

(12) United States Patent
Kleider

(10) Patent No.: US 7,014,547 B2
(45) Date of Patent: Mar. 21, 2006

(54) PORTABLE GRINDING MACHINE WITH PROTECTIVE COVER

(75) Inventor: Albert Kleider, Schwaebisch Hall (DE)

(73) Assignee: Robert Bosch GmbH, Stuttgart (DE)

( * ) Notice: Subject to any disclaimer, the term of this patent is extended or adjusted under 35 U.S.C. 154(b) by 3 days.

(21) Appl. No.: 10/818,481

(22) Filed: Apr. 5, 2004

(65) Prior Publication Data

US 2004/0203330 A1 Oct. 14, 2004

(30) Foreign Application Priority Data

Apr. 9, 2003 (DE) ..... 103 16 182

(51) Int. Cl.
*B24B 23/00* (2006.01)
*B24B 27/08* (2006.01)
*B24B 55/04* (2006.01)

(52) U.S. Cl. ..... 451/359; 451/451; 451/455; 451/344; 451/177; 451/259; 24/279; 24/280; 24/281; 24/282; 83/478

(58) Field of Classification Search ..... 451/359, 451/451, 455, 344, 177, 259; 24/268–286, 24/19–36; 83/478
See application file for complete search history.

(56) References Cited

U.S. PATENT DOCUMENTS 3,477,106 A * 11/1969 Tetzlaff et al. ..... 24/279
5,005,321 A * 4/1991 Barth et al. ..... 451/359
5,411,433 A * 5/1995 Keller ..... 451/451
5,637,035 A * 6/1997 Yee ..... 451/358
6,000,104 A * 12/1999 Mann ..... 24/274 R
6,464,573 B1 * 10/2002 Keller ..... 451/451
2002/0094769 A1 7/2002 Lai et al.
2004/0094962 A1 * 5/2004 Coffman ..... 285/420

FOREIGN PATENT DOCUMENTS

DE 295 13 331 U1 1/1997
DE 101 15 635 C1 10/2002
JP 9103959 4/1997

* cited by examiner

*Primary Examiner*—Joseph J. Hail, III
*Assistant Examiner*—Bryan R. Muller
(74) *Attorney, Agent, or Firm*—Michael J. Striker

(57) ABSTRACT

A portable grinding machine (10) includes an elongated housing (12, 14) and an output shaft (16) projecting at a right angle to the housing axis for receiving a disk-shaped rotary clamping tool. The output shaft is encompassed by a substantially cylindrical clamping collar (30), on which a shell-like protective cover (20) is secured in a tensile manner against rotation and axial displacement and which serves for encompassing the clamping tool (18) and which can be attached on the clamping collar (30) with a ring-shaped tensioning belt (28). The tensioning belt (28) has sharp-edged projections (32) projecting to the clamping collar, which upon clamping, born into the clamping collar and are held there in a form-locking manner (a shell-like tensioning band).

4 Claims, 3 Drawing Sheets

PORTABLE GRINDING MACHINE WITH PROTECTIVE COVER

BACKGROUND OF THE INVENTION

The present invention relates generally to a portable grinding machine with a protective cover.

A portable grinding machine with a protective cover is disclosed in DE 101 15 635 C1, which is attached to be rotatably overlooked and adjustable on the housing of the portable grinding machine. In this manner, the angle grinder protective cover is rotatably overlooked only in a selected direction; the opposite direction is locked.

The lock rotary direction runs the same as the working rotary direction of the rotary tool. Thus, even with existing shavings, work piece fragments, or debris of a rotary tool that can disrupt grinding by contact on the inner side of the protective cover, the protective cover cannot rotate.

The know solution functions satisfactorily and safely; however, it is made of many complex components, so that manufacturing costs are high.

SUMMARY OF THE INVENTION

The present invention has the advantage that a safe protective cover is provided, which can be rotated only in a preferred direction relative to the portable grinding machine, which can be made with minimal expense, whereby the associated portable grinding machine likewise can be made with reduced costs relative to similar portable grinding machines known to this point.

Because the clamping collar of the portable grinding machine is made from a softer material than the tensioning belt of the protective cover, this can bore or dig into the desired point with projections provided in the clamping collar, and thus can be locked in a form-locking manner into any rotational position with only one direction of rotation.

As the clamping collar of the portable grinding machine is left as a rough cast part, this part of the portable grinding machine can be made more cost effectively than metal-cut, machined clamping collars.

Since the clamping collar of the portable grinding machine is left as a conical cast part, its manufacture in a casting method is simple and cost effective. Due to the corresponding tensioning belt adapted to the cone and made from sheet steel, in which retaining tongues are applied, the protective cover can dig in over the tensioning belt on the conical clamping collar and hold fast to it in a form-locking manner.

The protective cover is only rotatable in one preferred direction, for example, against the direction of rotation of the grinding wheel, because the sharp edges of the cuttings emerge counter to a rotational direction to be locked radially inward over the inner contour of the tensioning belt to the clamping collar.

Because the tensioning belt can be actuated particularly quickly by means of a quick-acting lock, for example, a knee-lever lock or eccentric lever lock, without an auxiliary tool, the manageability and safety of the portable grinding machine with the protective cover is improved.

DETAILED DESCRIPTION OF THE PREFERRED EMBODIMENTS

Figure 1:
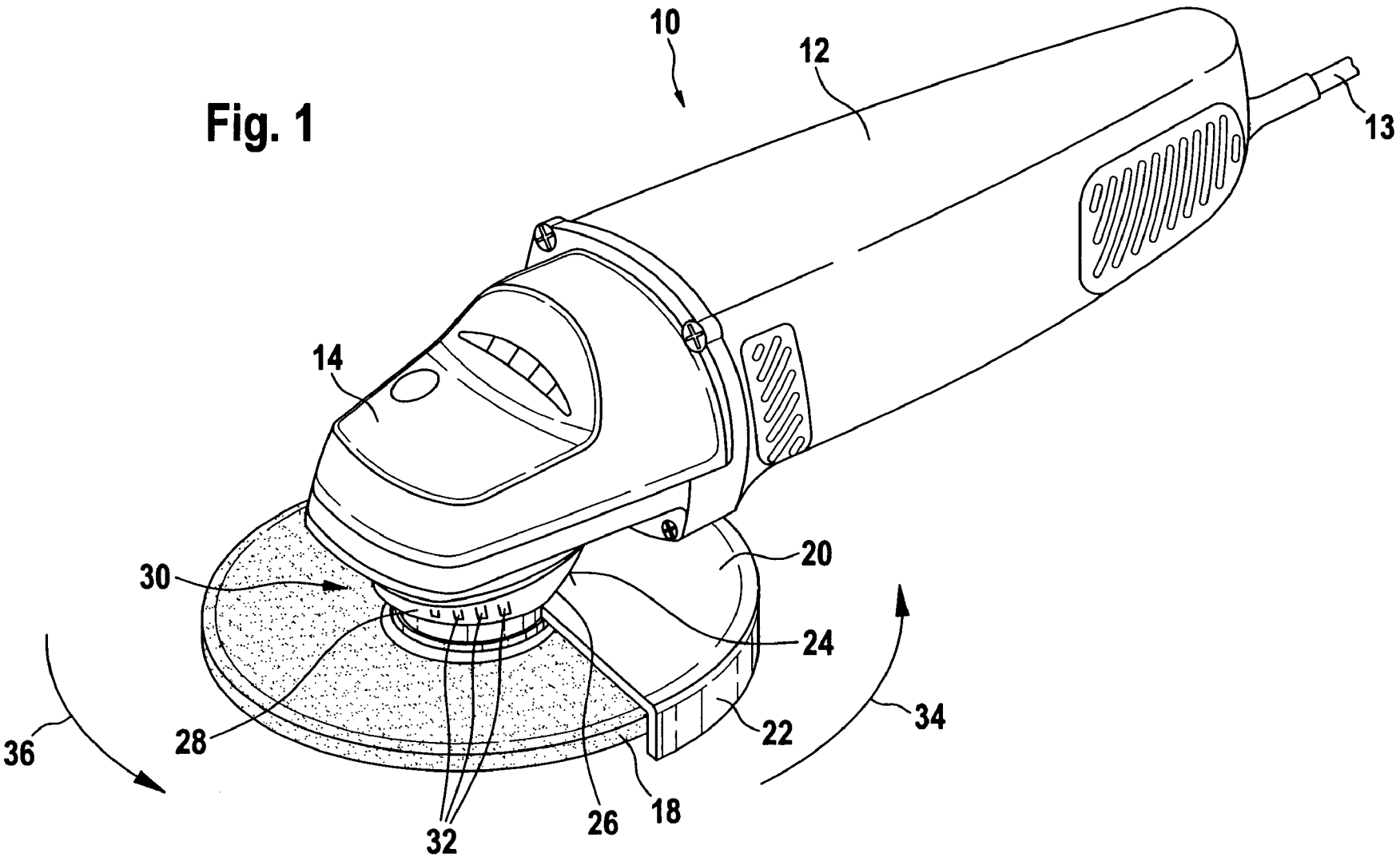
FIG. 1 shows a spatial representation of the portable grinding machine with protective cover according to the present invention.
Figure 2:
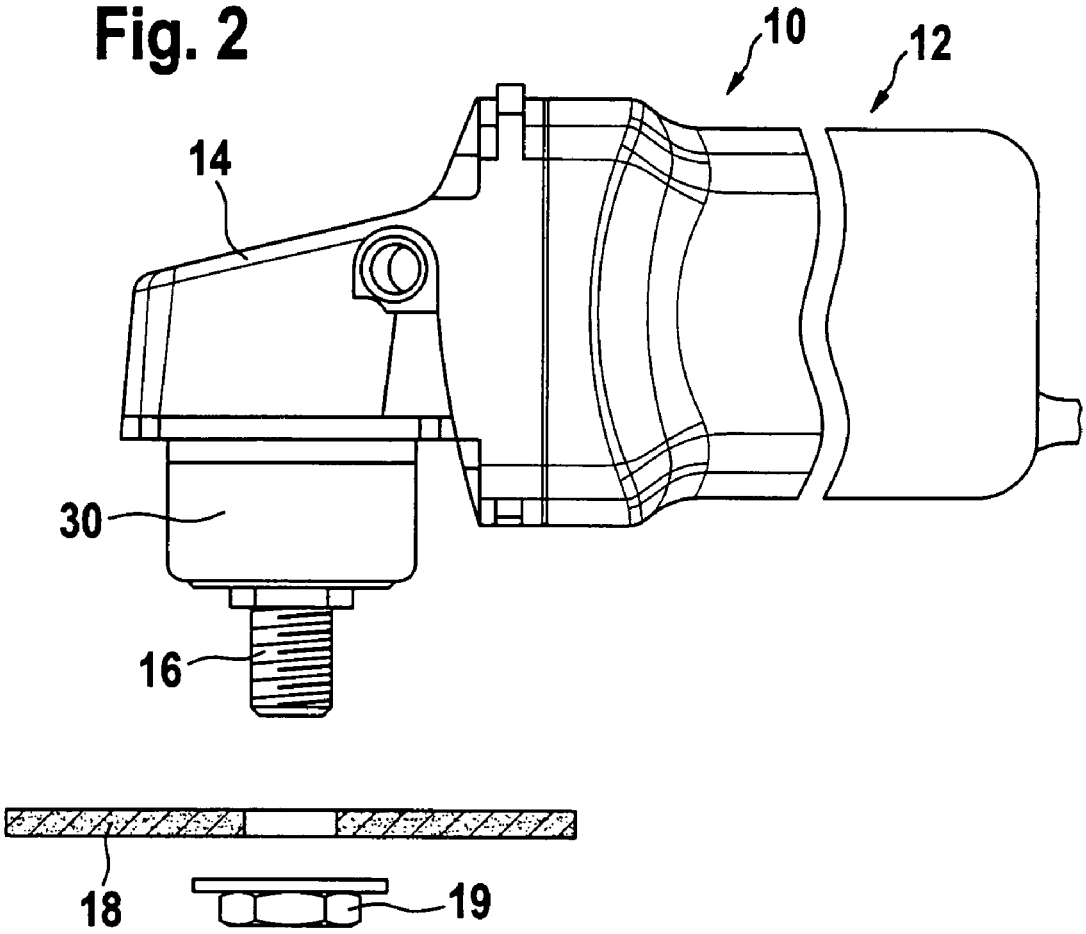
FIG. 2 shows the portable grinding machine without the protective cover with an exploded view of the grinding wheel with a clamping nut.

A portable grinding machine formed as an angle grinder 10 in FIG. 1 has an elongated motor housing 12. On this, a gear casing 14 is flange-mounted frontally, from which an output shaft projects transversely to the longitudinal axis of the motor housing 12 and gear casing 14 (FIG. 2). A grinding wheel 18 is rotatably clamped onto this.

The exit region of the output shaft 16 is formed as a cylindrical or conical clamping collar 30. On this, a protective collar 20 with a semi-circular base surface and with an edge 22 bent at a right-angle and engaging half of the circumference of the grinding wheel is clamped.

The protective cover 20 has a flange 26 bent upwardly at a right angle on a semi-circular, central section 24. The flange 26 is wrapped around by a parallel, ring-shaped tensioning belt 28, with which the protective cover 20 is tensible on the clamping collar 30 (FIG. 2) of the gear casing 14. The tensioning belt 28 has multiple pressed tongues 32 on its periphery, which are bent regularly radially inward to the clamping collar 30, such that they project radially inward over the inner contour of the tensioning belt or the flange 26 and bore into the clamping collar 30 upon stretching of the tensioning belt 28. In this manner, the protective cover is only rotatable radially only still in one selected direction in a friction-clutch manner and in the opposite directed, is fixed against rotation. Thus, the permitted direction of rotation of the protective cover 20, according to the arrow of the direction of rotation 34, is counter to the rotational direction of the grinding wheel 18 (according to the second arrow of the direction of rotation 36), so that the protective cover does not rotate unintentionally by contact with grinding chips or the like.

FIG. 2 shows the angle grinder 10 according to FIG. 1 in side view, however, without the protective cover, in an exploded view of the grinding wheel with a tensioning nut 19 relative to the output shaft 16 or the clamping collar 30. On the clamping collar 30, its cast chamfer can be clearly seen, whereby, here, reference is made specifically to the rough-cast surface of the clamping collar 30.

The output shaft 16 has a threading (not shown) on its free end, on which the applicable tensioning nut 19 can be screwed. For tensioning the grinding wheel 18, first it is shifted with its central inner bore (not shown) over the threaded region of the output shaft 18 until reaching an axial position on the inner flange (not shown), and subsequently secured by screwing on the tensioning nut 19.

Figure 3:
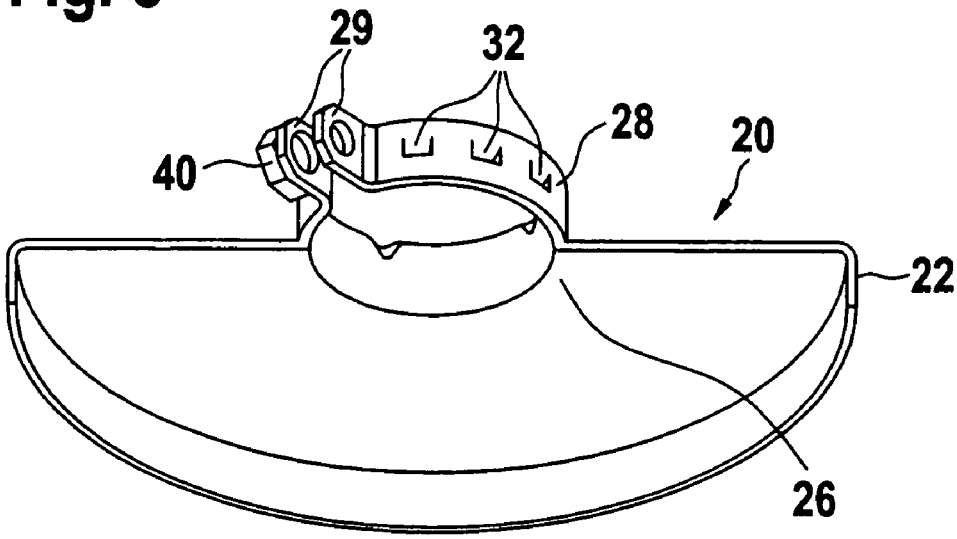
FIG. 3 show a spatial representation of the tensioning belt of the protective cover.

FIG. 3 shows a spatial view of the protective cover 20 with the tensioning belt 28, which encompasses the central ring-shaped flange upwardly bent from the semi-circular surface of the protective cover 20 and is connected with it by means of a welded connection. The tensioning belt 28 forms an almost completely closed ring. This encompasses the conical-cylindrical clamping collar 30 two-dimensionally, since it is adapted based on its elasticity to the conical shape. Upon tightening of the cover plates 29 by means of a tensioning nut (FIG. 5) or by means of a quick-acting means (not shown), such as a knee lever or eccentric lever, the tensioning belt 28 remains secure with increased force first in a force-transmitting manner on the clamping collar 30. At the same time, the pressed tongues 32 bore into the rough-cast surface of the clamping collar 30 and supply a form-locking fixing of the tensioning belt 28 or the protective cover 20 on the clamping collar 30 in one direction of rotation.

Figure 4:
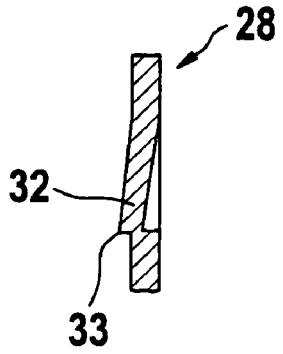
FIG. 4 shows a cross section of the tensioning belt.

FIG. 4 shows a cross section of the tensioning belt 28 in the region of a pressed tongue 32, which has radial inward sharp edges 33 and thereby extend over the inner contour, so that it can bore into the clamping collar in the manner of a thorn.

Figure 5:
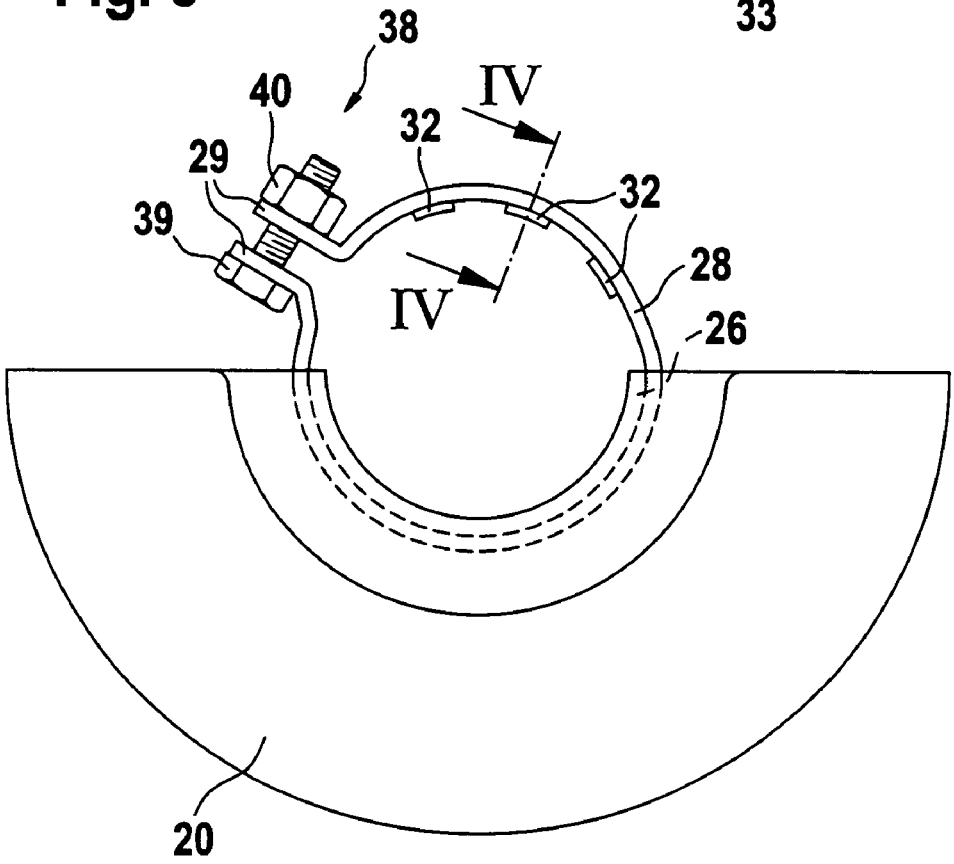
FIG. 5 shows a plan view of the protective cover.

FIG. 5 shows a plan view of the protective cover 20 with the tensioning belt 28, which encompasses the flange 26 outwardly, and therewith, bears the entire protective cover 20. The pressed tongues 32, which are relatively large compared to the preceding figures, are pressed radially and laterally from the outside to the inside into the tensioning belt, whereby, respectively, one free cover of the U-shaped pressed tongues 32 projects further radially inward than the other. In this manner, the U-shaped tongues run at a slant to the tensioning belt, so that one of the tips can bore more intensely than the others into the clamping collar. If the protective cover 20 is rotated opposite to the clamping collar 30, such that it is pressed into the collar in the manner of a barb still deeper, it locks itself only after an extremely minimal twisting movement, so that, accordingly, no further rotation in this direction is possible. If the protective cover 20 is rotated, in contrast, such that the more deeply drilled tooth is pulled from its self-drilled depression, based on the tilt of the U-shaped tongue, a further desired rotation in this direction is possible. It is to be noted in this connection that before rotation, of course, an fixed tensioning device 38 that can tighten the cover plates 29 onto one another or move them away from each other is actuated, such that the radial pressure of the tensioning belt 28 on the clamping collar 30 is reduced and after achieving the desired position of the protective cover 20, the tensioning device 38 is again clamped tightly.

The tensioning device comprises a screw 39, which passes through both cover plates 29, such that is rests with its screw head on the first cover plate and on its free end, corresponds with a nut 40, which contacts outwardly on the second cover plate 29. The nut 40 can be fixed on the outer side of the cover late 29 by welding or the like and is thereby unreleasably fixed.

Figure 6:
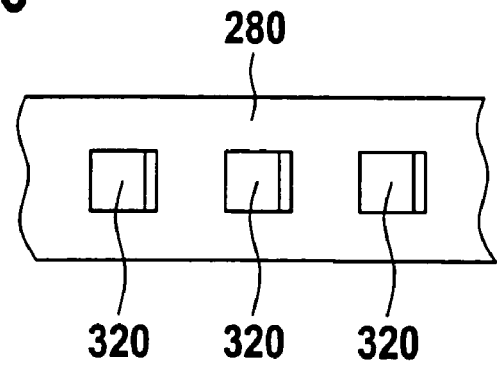
FIG. 6 is a section of a further variation of the tensioning belt.

FIG. 6 shows an enlarged section of a further variation of a tensioning belt 280, in which peripheral, U-shaped tongues 320 are pressed parallel to the circumferential direction of the tensioning belt 280. The impressions are selected, such that the inwardly projected edges of the pressed tongues 320 permit only a preferred rotational direction of the tensioning belt and, therewith, the protective cover 20.

This preferred direction is fixed for all of the described figures counter to the direction of rotation of the grinding wheel 18, so that it does not rotate unintentionally with the presence of grinding chips or coarser work piece parts or with disruption of the grinding wheel 18, and interrupt the user of the machine with particles flung about at high speed.

It will be understood that each of the elements described above, or two or more together, may also find a useful application in other types of constructions differing from the types described above.

While the invention has been illustrated and described herein as a portable grinding machine with a protective cover, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A portable grinding machine (10), comprising:

an elongated housing (12, 14) and an output shaft (16) accommodated in the housing for receiving a disk-shaped rotary clamping tool, wherein the output shaft is encompassed by a substantially cylindrical clamping collar (30), on which a shell-like protective cover (20) is secured in a tensile manner against rotation and axial displacement, wherein said protective cover serves to encompass the clamping tool and, by means of a ring-shaped tensioning belt (28), is attached to the clamping collar (30), wherein the tensioning belt (28) has sharp-edged projections (32) projecting to the clamping collar, which upon clamping, bore into the clamping collar (30) and are held tightly in a form-locking manner onto the clamping collar, wherein the tensioning belt is made from sheet metal and the projections are pressed tongues (32) with at least one sharp tip or edge, wherein the at least one sharp edge or tip is arranged counter to a preferred direction of rotation of the protective cover (20) to enter the clamping collar at an incline, so that the protective cover (20) only is rotatable in the preferred direction against a direction of rotation of a grinding wheel.

2. The portable grinding machine according to claim 1, wherein the clamping collar (30) is made from a softer material than the projections (32) or the tensioning belt (28).

3. The portable grinding machine according to claim 1, wherein the clamping collar (30) is rough cast on an exterior surface.

4. The portable grinding machine according to claim 1, wherein the clamping collar is part of an aluminum-cast piece and has a chamfer.

* * * * *